United States Patent [19]

Jenkner et al.

[11] Patent Number: 4,501,075

[45] Date of Patent: Feb. 26, 1985

[54] APPARATUS FOR REMOVING CONDENSATE FROM A STEAM HEATED ROTATABLE DRYING CYLINDER AND THE LIKE

[75] Inventors: Karl Jenkner, Heidenheim; Karl Steiner; Robert Wolf, both of Herbrechtingen, all of Fed. Rep. of Germany

[73] Assignee: J. M. Voith, GmbH, Heidenheim, Fed. Rep. of Germany

[21] Appl. No.: 446,959

[22] Filed: Dec. 6, 1982

[30] Foreign Application Priority Data

Dec. 10, 1981 [DE] Fed. Rep. of Germany ..... 3148948

[51] Int. Cl.[3] ..... F26B 25/20

[52] U.S. Cl. ..... 34/125; 34/119; 34/124

[58] Field of Search ..... 34/119, 124, 125

[56] References Cited

U.S. PATENT DOCUMENTS

| | | | |
|---|---|---|---|
| 2,892,264 | 6/1959 | Armstrong | 34/125 |
| 2,993,282 | 7/1961 | Daane et al. | 34/125 |
| 3,328,896 | 7/1967 | Hanf | 34/125 |

FOREIGN PATENT DOCUMENTS

| | | | |
|---|---|---|---|
| 702326 | 1/1965 | Canada | 34/125 |
| 244138 | 4/1965 | Fed. Rep. of Germany . | |
| 2335939 | 1/1975 | Fed. Rep. of Germany | 34/125 |
| 2930985 | 2/1981 | Fed. Rep. of Germany . | |
| 2903170 | 9/1981 | Fed. Rep. of Germany . | |
| 303 | of 1864 | United Kingdom | 34/125 |

*Primary Examiner*—Larry I. Schwartz

*Attorney, Agent, or Firm*—Lon H. Romanski

[57] ABSTRACT

A relatively stationary pipe or conduit, for the removal of a condensate or liquid from the interior of a steam heated rotatable drying drum or cylinder assembly and adapted for connection to a source of relatively low or sub-atmospheric pressure, has an inner end portion, disposed within the drum or cylinder assembly, which is provided with an inlet opening or port disposed in juxtaposition and close proximity to an inner cylindrical surface of the cylinder assembly; the inlet opening has a generally rearwardly situated wall which is substantially inclined as with respect to a radial plane of the cylinder assembly as to provide for enhanced transitional flow of the condensate from the inner cylindrical surface of the cylinder assembly to the condensate-removing pipe or conduit.

6 Claims, 7 Drawing Figures

APPARATUS FOR REMOVING CONDENSATE FROM A STEAM HEATED ROTATABLE DRYING CYLINDER AND THE LIKE

FIELD OF THE INVENTION

This invention relates generally to rotatable drying cylinder assemblies and more particularly to such drying cylinder assemblies which employ steam flowing to the interior thereof for heating thereof and, further, to apparatus associated with such drying cylinder assemblies for the removal of condensate, resulting from the cooling of said steam, from the interior of said drying cylinder assembly.

BACKGROUND OF THE INVENTION

In various industries or arts, it is necessary, as part of the overall process, to dry a continuous sheet or strip of material. For example, in the art of paper-making, the relatively wet or damp strip or web of paper fibers is often passed over and mostly about a rotatable drum or cylinder assembly which is heated in order to thereby evaporate the moisture of the wet or damp paper sheet in contact with and passing about the outer cylindrical surface of such rotatable drum or cylinder assembly.

The prior art has employed steam for the heating of such rotatable drying drums or cylinder assemblies. More specifically, heretofore, the prior art has employed a drying cylinder or drum assembly comprised of a cylindrical shell having axially closed end-walls defining an inner chamber into which, as through the axis of rotation in an end wall, steam is supplied in order to sufficiently heat the cylindrical shell, and the outer cylindrical surface thereof, and thereby achieve the desired degree of drying of the paper sheet or material passing in contact with the said outer cylindrical surface.

The steam thusly admitted into the inner chamber of the drying cylinder or drum assembly, upon giving-up some of its heat, forms a condensate within said inner chamber and, obviously, such condensate must be removed in order to maintain a continuous drying process.

Heretofore, the prior art as disclosed, for example, by Austria Letters Patent No. 244,318, has proposed the use of a suction type conduit means for the removal of condensate from the interior of such a steam heated rotatable drying cylinder assembly. In such a proposed prior art apparatus, the pressure generally downsteam of the condensate-removing conduit means is maintained at a magnitude less than the pressure within the interior of the drying cylinder assembly and the steam, to the interior of the cylinder assembly, is supplied in such a volume and under such a pressure as to result in a portion of such steam flowing as a high speed stream through a gap or clearance formed between the surface of the film of condensate and the juxtaposed rim of an inlet leading to and cooperating with the suction conduit means. The purpose of creating such a high speed stream was to cause the stream to entrain therein part of the liquid forming the film of condensate. Such a prior art proposed condensate removing system was based on the assumption that the condensate would, during comparatively high peripheral velocities of the drying cylinder assembly, form a continuous inner cylindrical ring or film of constant thickness on the inner surface of the cylindrical shell. Such a prior art proposed condensate-removing system was found to be generally acceptable even where the peripheral velocity of the drying cylinder assembly was so low as to result in a sump, puddle or pool of condensate in the lower portion of the interior of the drying cylinder assembly.

However, especially in the paper making art, the working speeds of such drying cylinder assemblies have undergone, in the recent past, steady increases as to thereby obtain greater rates of paper production. It has been found that in such instances, where significantly higher rotational velocities are experienced by the drying cylinder assemblies, a recognizable continuous strip-like pattern is formed in the paper sheet. Such strip pattern has been found to be, generally, over-dried as compared to the remainder of the stock forming the paper sheet. Further, it has been found that such strip pattern is produced in the paper sheet at a location which corresponds to the axial position, along the axis of the drying cylinder assembly, at which the inlet end or intake head of the condensate-removing conduit means is situated.

It has been found that at such relatively high rotational speeds, the remaining condensate (not removed by the intake head or inlet structure) forms a spurting and turbulent zone behind the intake head or inlet structure. As a consequence of such turbulent zone, in the condensate layer remaining behind the inlet structure, the rate of heat transfer, in that zone, from the interior to the exterior cylindrical surface of the drying cylinder assembly is significantly increased causing the outer cylindrical surface to have a ring-like annular area of a temperature which is too hot and such annular area then has the effect of comparatively over-drying the portion of the paper sheet coming in contact therewith.

Heretofore, it has been proposed by the prior art that in order to overcome such a problem of an over-heated zone on the drying cylinder one should employ an intake head or inlet structure sometimes referred to as a "peel-syphon" type and disclosed, for example, in Federal Republic of Germany Patent Office Publication No. AS-29-03-170. In such a prior art inlet structure the inlet opening thereof has a somewhat peeling action on the film or layer of condensate. The kinetic energy of such peeled portion of the condensate partly assists the flow of such peeled condensate into and through the associated condensate-removing conduit means. However, the major motivating and removing force of such peeled condensate is the transporting and entraining effect of a high speed stream of steam flowing through a gap or clearance formed between the surface of the film of condensate and the juxtaposed edge or rim of the inlet opening of the inlet structure (much as disclosed by said Austria Letters Patent No. 244,318). One of the serious disadvantages of such a prior art inlet structure is that there is a comparatively high usage of steam; further, the thickness of the remaining condensate film or layer is comparatively large resulting in the rate of heat transfer to the outer cylindrical surface of the dryer cylinder assembly being reduced from the desired rate. Still further, such a "peel-syphon" type of structure proposed by the prior art is capable of removing at most only a small portion of the condensate from the drying cylinder when such drying cylinder is used in a drying process employing slow working speeds resulting in the formation of a condensate sump or pool in the lower part of the interior of the drying cylinder.

Other prior art attempts at eliminating the creation of such an overly-heated zone on the drying cylinder have not been found to be acceptable. One suggestion was to form an inner circumferential groove within the inner surface of the drying cylinder with such groove being positioned generally in a plane passing normal to the axis of rotation of the drying cylinder and passing through the medial portion of the intake head or inlet structure. Such was found not to correct the problem of creating an over-heated zone.

The prior art also suggested making the drying cylinder axially overly-long as to be significantly axially longer than the width of the paper sheet to be passed thereagainst and then placing the condensate intake head or inlet structure at a position as to be situated axially beyond the edge of the paper sheet. This has not been found acceptable.

The prior art has also suggested that a plurality of drying cylinder assemblies, arranged in series, be employed for collectively drying the paper sheet sequentially engaging such drying cylinders. More specifically, the prior art contemplated positioning the respective condensate intake heads or inlet structures at differing axial locations as to, in effect, created respective overly-heated zones which would not be aligned with each other and then partially but unevenly drying the paper sheet as it passes against each drying cylinder with the hope that thereby, through such overlapping cumulative drying the finally dried paper sheet would not exhibit the undesired overly-dried strip therein.

The prior art has also proposed preventing the creation of an overly-heated zone, on the dryer cylinder, by employing a heat insulating ring on the inner cylindrical surface of the drying cylinder as to be passing (during rotation of the dryer cylinder) in juxtaposition to the condensate intake head or inlet structure. Such a prior art structure, as disclosed generally by Federal Republic of Germany Patent Office Publication No. OS-29-30-985, has not been found acceptable.

Further, the prior art has proposed the use of rotating, instead of stationary, condensate intake heads or inlet structures in order to prevent the creation of an overly heated zone on the drying cylinder. However, this has not been found acceptable especially in view of the dramatically increased pressure differential and steam consumption necessary to overcome the centrifugal force tending to prevent the condensate from flowing through the associated conduit means toward the axis of rotation.

The invention as herein disclosed and described is primarily directed to the solution of the aforestated as well as other related and attendant problems of the prior art.

SUMMARY OF THE INVENTION

According to the invention, an intake structure, for receiving therein condensate from an inner chamber of a steam heated drying cylinder assembly which is rotatable about an axis of rotation, which has a generally cylindrical inner surface defining a portion of said inner chamber and against which said condensate forms, and which has a stationary condensate-transporting conduit means for delivering condensate to a receiving area externally of said drying cylinder assembly, comprises nozzle-like body means, an inlet opening formed in said nozzle-like body means, an outlet formed in said nozzle-like body means and being effective for communication with said stationary condensate-transporting conduit means, said inlet opening being juxtaposed to and open towards said cylindrical inner surface when said nozzle-like body means is operatively connected to said stationary condensate-transporting conduit means in order to achieve said communication with said outlet, said inlet opening having forwardly and rearwardly disposed wall portions, said nozzle-like body means when operatively connected to said stationary condensate-transporting conduit means being so positioned as to have said forwardly and rearwardly disposed wall portions so arranged with respect to each other as to result in the rotating cylindrical inner surface first traverse said forwardly disposed wall portion and subsequently traverse said rearwardly disposed wall portion, and wherein said rearwardly disposed wall portion has a generally inner surface means effective for scooping at least a portion of said condensate from said rotating cylindrical inner surface and directing such scooped condensate into said stationary condensate-transporting conduit means.

Various other general and specific objects, advantages and aspects of the invention will become apparent when reference is made to the following detailed description considered in conjunction with the accompanying drawings.

BRIEF DESCRIPTION OF THE DRAWINGS

In the drawings, wherein for purposes of clarity certain details and/or elements may be omitted from one or more views.

DETAILED DESCRIPTION OF THE PREFERRED EMBODIMENT

Figure 1:
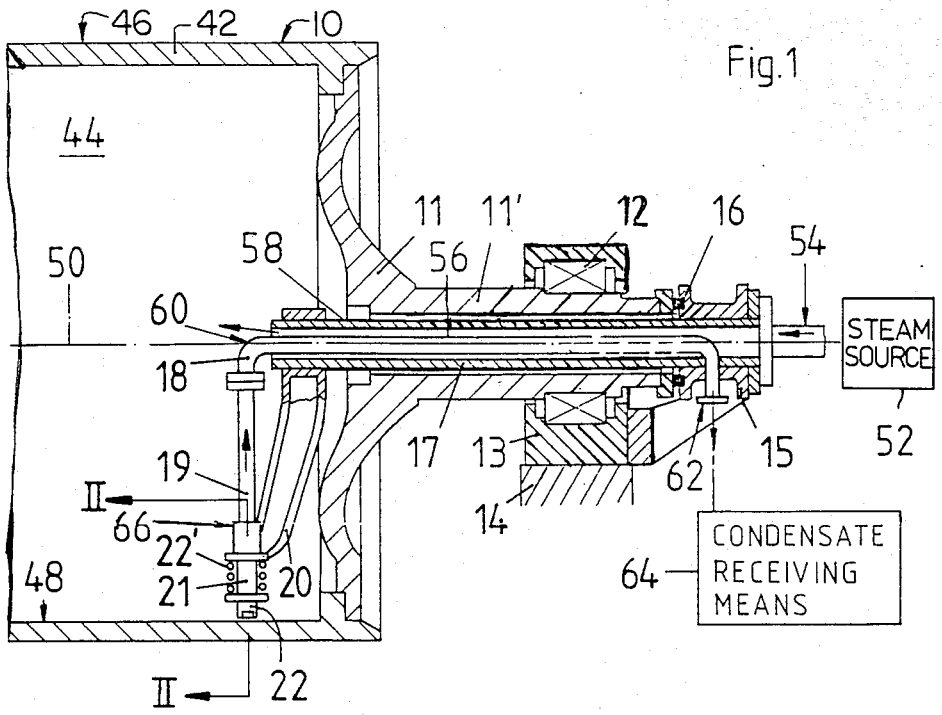
FIG. 1, in somewhat simplified and/or schematic form, illustrates in axial cross-section a fragmentary portion of a drying cylinder or drum assembly employing apparatus, embodying teachings of the invention, for removing condensate from the interior of the drying cylinder assembly.

Referring now in greater detail to the drawings, a rotatable drying cylinder or drum assembly 10, shown fragmentarily, comprises a cylindrical portion 42 with end closure walls, one of which is illustrated at 11, defining therewithin a chamber 44. The outer cylindrical surface 46 may be considered the rotatable drying surface against which, for example, the paper sheet is brought into contact for the drying thereof. The inner cylindrical surface 48 is that surface against which the steam condensate collects during operation and rotation of the cylinder assembly 10.

In the arrangement illustrated a portion 14, of the overall machine structure or apparatus, serves as a mounting or support as for an associated stationary bearing housing means 13 which, in turn, houses, for example, roller bearing means 12. A generally tubular extension portion 11', which may be carried by the end wall 11, serves as a journal means by being received as within bearing means 12 for rotation about the axis 50. A support portion similar to portion 14 and, for example, a solid journal means functionally similar to 11' may be provided as at the opposite axial end of the cylinder assembly 10.

A suitable source of steam 52 is operatively connected, as through conduit means 54 and coupling means 15, to inner chamber 44 by means of a stationary steam feed-pipe or conduit 17 which, as depicted, is carried and supported by the coupling means 15. Suitable ring-like sealing means 16 is preferably provided as between the stationary coupling means 15 and the rotatable hollow or tubular journal portion 11'.

A condensate-removing or transporting conduit means 56 is illustrated as comprising conduit portions 18 and 19. Conduit portion 18 extends axially through the inner passage 58 of stationary steam feed-conduit 17 and has oppositely situated end portions 60 and 62 with end portion 60 being operatively connected to generally radially extending conduit portion 19 and with end portion 62 being adapted for returning the removed condensate to a related condensate receiving means 64.

The radially outer-most portion of conduit section 19 may be provided as with a tubular connector portion 66, secured to and carried by conduit 19 and also secured to one end of a support arm 20 which has its other end fixedly secured as to the projecting end of stationary steam feed-conduit 17. The connector 66, serving as a functional extension of conduit portion 19, slidably telescopingly receives a conduit portion 21 of the associated intake or inlet structure 22 thereby providing for some degree of movement, radially of axis 50, of inlet structure 22. A spring 22' serves to hold the inlet structure 22 spaced a small distance away from inner cylindrical surface 48 and allows for limited movement or deflection of the inlet structure 22 relative to the axis 50.

Figure 2:
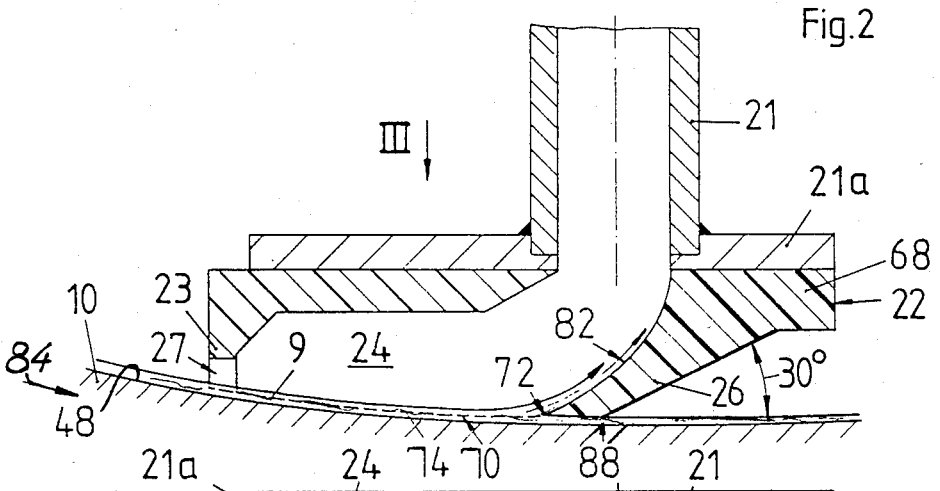
FIG. 2 is a relatively enlarged cross-sectional view taken generally on the plane of line II—II of FIG. 1 and looking in the direction of the arrows and illustrating a preferred embodiment of an inlet structure according to the invention.
Figure 3:
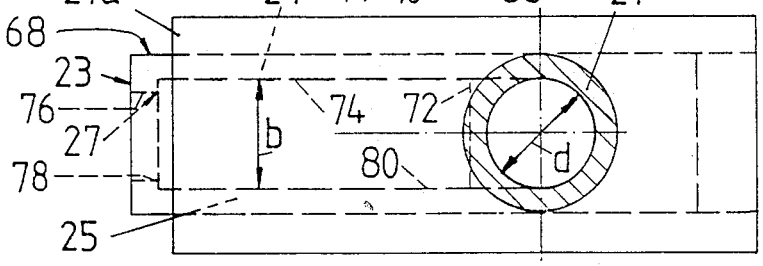
FIG. 3 is a view taken generally in the direction of arrow III of FIG. 2.

Referring to FIGS. 2 and 3, the preferred embodiment of the inlet or intake structure 22 is illustrated as comprising a nozzle-like generally box-shaped body means 68 which, although being capable of being made of any suitable material, in the preferred embodiment, is formed of plastic material. The use of plastic material minimizes the magnitude of the frictional forces generated should the body means 68 touch inner cylindrical surface 48 during rotation of cylinder assembly 10. A flange member 21*a* is secured to conduit portion 21, as by welding, and body means 68 is, in turn, suitably secured to flange 21*a* as by any suitable means as for example by screws (not shown).

As depicted, in the preferred embodiment, nozzle-like body means 68 comprises a forwardly disposed wall portion 23 and a rearwardly disposed wall portion 26 which are, preferably, integrally formed with lateral or longitudinally extending opposed side wall portions 24 and 25.

The inlet opening 70 of the nozzle-like body means 68 is formed in the radially outer-most portion of the body means 68, as to be juxtaposed to inner cylindrical surface 48, and is peripherally defined as by relatively sharp edge 72 and edges 74, 76, 78 and 80.

In the preferred embodiment, the inner surface 82 of rearward wall 26 is formed as provide a relatively sharp edge 72, at its lower-most portion as viewed in FIG. 2, so that such edge 72, serving as for example a peeling-knife or scoop, effectively peels or scoops a layer of condensate from the rotating cylinder assembly 10 (rotation being in the direction of arrow 84 of FIG. 2) and directs such scooped condensate into conduit portion 21 and communicating condensate-removing conduit means 56 for transport to the receiving means 64. Further, in the preferred form, surface 82 is contoured as to provide a smooth and continuous transitional surface so that, as much as possible, the kinetic energy of the condensate being scooped will be used in causing the condensate to flow into through conduit means 21 and 56.

The outer surface of rearward wall 26 is preferably formed as to be inclined in the order of 30°. More particularly, the angle formed by the outer surface of wall 26 would be measured with respect to a reference plane tangent to an arc passing through point 88, as at the lower edge of the inclined surface, and having its center of rotation coincident with axis 50. Further, in the preferred embodiment, surface 82, in the region relatively close to peeling or scooping edge 72, would form a similarly inclined angle in the order of 30°.

In the preferred embodiment, the overall exterior width of nozzle-like body means 68 (as best seen in FIG. 3) is only in the order of one-quarter the overall exterior length of such body means 68 and the inner width, b, of the opening 70 is preferably only equal to the diameter, d, of conduit means 21.

Even though not considered to be essential, in the preferred embodiment forward wall portion 23 has a recess or clearance passage 27 formed therethrough as to provide for some degree of communication as between the interior of opening 70 and an area forward (to the left as viewed in FIG. 2) of forward wall portion 23. Such opening or clearance 27 enables a portion of the steam (supplied to chamber 44 via steam feed-conduit means 17) to stream therethrough and into the interior of nozzle body means 68 and, in so doing, also entrain some of the condensate to be carried away via conduit means 56.

Figure 4:
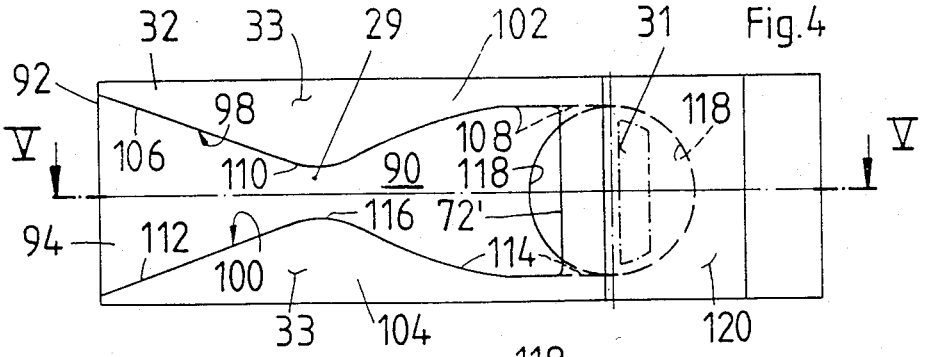
FIG. 4 is a bottom elevational view of another embodiment of an inlet or intake structure embodying teachings of the invention.
Figure 5:
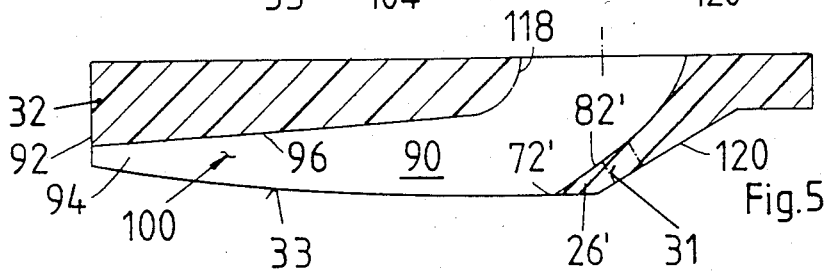
FIG. 5 is a cross-sectional view taken generally on the plane of line V—V of FIG. 4 and looking in the direction of the arrows.

In the embodiment of FIGS. 4 and 5, the nozzle-like body means 32 is illustrated as comprising an opening or passage means 90 which, when viewed as in FIG. 4, is of a venturi-like configuration. More particularly, the forward end 92 of body means 32 has formed therein the inlet end 94 of passage or opening 90 while the rearward wall 26' (functionally similar or equivalent to wall 26 of FIG. 2) is provided with a peeling or scooping edge 72' (functionally similar or equivalent to edge 72 of FIG. 2). A surface 96 forms the upper surface (as viewed in FIG. 5) of the passage or opening 90 while the generally longitudinal side surfaces of the opening 90 are formed as by opposed inner surfaces 98 and 100 respectively formed as on integrally formed side wall portions 102 and 104, while the rearward surface of opening 90 is defined by inclined inner surface 82' which is functionally similar and equivalent to surface 82 of FIG. 2. As best seen in FIG. 4, side surfaces 98 and 100 may each be considered as comprising, generally three surface portions or zones. That is, surface means 98 may be considered as comprising forwardly situated surface portion 106, rearwardly situated surface portion 108 and intermediate joining surface portion 110, while surface means 100 may be considered as comprising forwardly situated surface portion 112, rearwardly situated surface portion 114 and intermediate joining surface portion 116. Surfaces 106 and 112 cooperate to define a relatively wide entrance-like area and progressively narrow such area to where a minimal width is cooperatively defined by opposed generally rounded surface portions 110 and 116 which effectively define the venturi throat 29. Rearwardly or downstream of such venturi throat 29, the opposed surfaces 108 and 114 progressively widen the space therebetween until the width thereof is equal to the diameter of the exit conduit portion 118 which, preferably is equal to the flow diameter of the conduit portion 21 (shown in FIGS. 1 and 2) which may be operatively connected to body means 32 in the same manner as described with regard to body means 68 of FIG. 2.

Further, the body means 32 when assembled into an overall inlet structure, as, for example disclosed in FIGS. 2 and 3, the position of such body means 32 would be as that illustrated by body means 68 and thereby placing the stream entrance 94 to be first traversed by the rotating cylinder 42. The entrance 94, as should now be apparent, of relatively little height (as viewed in FIG. 5) but is of very considerable width (as viewed in 4). As the condensate 9 is effectively impacted into passage or opening 90 and as it flows, relatively, through throat 29 the velocity of such condensate is increased thereby aiding in the entrainment of additional condensate rearwardly of throat 29 and increasing the kinetic energy of the condensate to enhance its subsequent flow against transitional surface means 82' and out of exit conduit portion 118.

As in the embodiment of FIGS. 2 and 3, in the preferred configuration of the embodiment of FIGS. 4 and 5, the rearward wall 26' has its outer surface 120 also inclined at an angle in the order of 30° with such being determined generally in the same manner as described with regard to the outer inclined surface of wall 26 of FIG. 2. Further, it is preferred that at least a portion of the transitional surface 82', closely situated to the relatively sharp peeling or scooping edge 72', also be at the same angle (i.e. in the order of 30°) as also discussed in regard to FIG. 2. The outer surfaces 33—33 of side wall portions 102 and 104 are of arcuate configuration as to be generally concentric to the inner cylindrical surface 48, of cylindrical assembly 10, but closely spaced therefrom. If desired, a passage 31 may be formed through rearward wall 26' as to, for example, have a location and configuration as generally depicted in phantom line at 31 of each of FIGS. 4 and 5. The provision of such an aperture or passage 31 is discussed in said Federal Republic of Germany Patent Office Publication No. AS-29-03-170.

Figure 6:
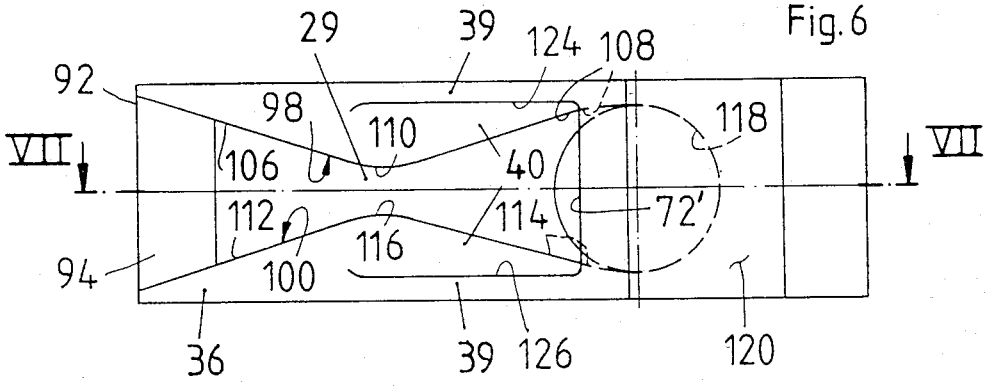
FIG. 6 is a bottom elevational view of still another embodiment of an inlet or intake structure embodying teachings of the invention.
Figure 7:
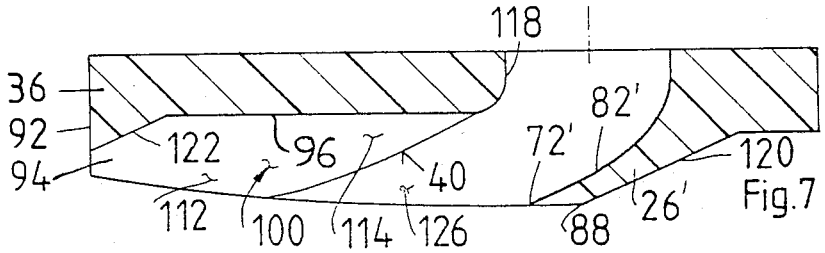
FIG. 7 is a cross-sectional view taken generally on the plane of line VII—VII of FIG. 6 and looking in the direction of the arrows.

FIGS. 6 and 7 illustrate yet another embodiment of the invention. In FIGS. 6 and 7, except as otherwise noted, elements which are like or similar to those of FIGS. 6 and 7 (or FIGS. 2 and 3) are identified with like reference numbers.

In the main, nozzle-like body means 36 departs from body means 32 (of FIGS. 4 and 5) by having, for example, surface 96 more nearly raised and then having a relatively short downwardly sloping surface portion 122 leading to the entrance 94. Further, the side walls are contoured as to have respective surface portions 40—40 blending generally inwardly and toward the exit conduit portion 118. Such blending of surfaces may start, for example, and preferably, in the region of and preferably slightly forwardly of the venturi throat 29. As a consequence relatively narrow outwardly projecting wall surfaces 39—39 are formed which, in turn, have inner surface portions 124 and 126, preferably spaced from each other a distance equal to the diameter of the exit conduit portion 118, which tend to confine condensate therebetween and channel the flow thereof directly to such exit conduit portion 118 and conduit means 21 communicating therewith.

As stated with regard to the body means 32 of FIGS. 4 and 5, the body means 36 of FIGS. 6 and 7 may be operatively connected to conduit means or section 21 in the same manner as discussed with reference to FIGS. 2 and 3.

As already disclosed, it is preferred that the width, b, (FIG. 2) of the opening or inlet of the body means be at least equal to the inner diameter, d, of the rising conduit 21. Further, in the event that the flow passage of such a rising pipe section 21 is of a cross-sectional configuration other than circular, it is preferred that such inner width, b, be at most equal to:

$$\sqrt{\frac{4 \cdot A}{\pi}}$$

where A is equal to the cross-sectional area of the flow passage of such a rising pipe section 21 and $\pi$ is the mathematical constant, pi.

It has been found that by providing a rearward wall, as at 26 and/or 26', and forming the rearward outer surface thereof, as at, for example, 120, at an angle in the order of 30°, the condensate turbulance experienced with the prior art structures directly behind the inlet or intake structure is at least greatly reduced. Consequently, the over-heated ring-like or annular area on the outer surface of the drying cylinder, resulting from such condensate turbulence in the prior art is effectively eliminated thereby preventing the occurrence of the over-dried strip pattern in the paper sheet being dried.

As typically illustrated, for example, by FIG. 7, the rearwardly situated wall 26' is preferably formed as to have a thickness which will maintain the structural integrity thereof and yet present surface 120 as close as possible to the inner surface 82' thereby effectively resulting in the distance as from edge 72' to point or edge 88 being at a minimum.

As already disclosed, a possible embodiment of the invention comprises side intake-passage defining or limiting walls (for example, 25 and 25 of FIG. 3 or 102 104 of FIG. 4) which extend effectively for the full length of the lower-most portion of the body means (68 or 32) in close proximity to the curvature of the inner cylindrical surface 48 of cylinder 42.

Also, as already disclosed, a possible embodiment of the invention comprises side intake-passage defining or limiting walls (for example 40—40 of FIG. 6) which are effectively cut-back or contoured as to extend further away from the inner cylindrical surface 48 of cylinder 42 as such surfaces (40—40) more nearly approach the rearward portion of the intake or inlet cavity or chamber. This, of course, tends to direct greater flows of condensate smoothly into the conduit means 21.

Still further, a possible embodiment of the invention comprises an aperture or passage means, as generally indicated at 31 of FIGS. 4 and 5, formed through the rearward wall 26' as to thereby permit the escape of a portion of the steam, streaming into the inlet or intake structure, so as not to in effect cause a choking effect as in the conduit means 21 by an excess of steam which, in turn, would diminish the flow of condensate therethrough.

It is contemplated that the invention may be employed in an overall system wherein a pressure differential is created, as by exposing conduit means 56 to a vacuum source, in order to thereby assist in the flow of condensate from chamber 44 to receiving means 64. However, it has been discovered that inlet or intake structures embodying teachings of the invention function so well that it is not necessary to create such pressure differentials. This, of course, results in a savings in the cost of producing such a pressure differential and, further, prevents the occurrence of any damage to the associated product, as for example paper sheet, if in a system employing the invention and employing a created pressure differential a condition should occur whereby a loss of such pressure differential is experienced.

Although only a preferred embodiment and selected modifications of the invention have been disclosed and described, it is apparent that other embodiments and modifications of the invention are possible within the scope of the appended claims.

What is claimed is:

1. An intake structure for receiving therein condensate from an inner chamber of a steam heated drying cylinder assembly which is rotatable about an axis of rotation, which has a generally cylindrical inner surface defining a portion of said inner chamber and against which said condensate forms, and which has a stationary condensate-transporting conduit means for delivering condensate to a receiving area externally of said drying cylinder assembly, said intake structure comprising nozzle-like body means, inlet opening means formed in said nozzle-like body means, an outlet formed in said nozzle-like body means and being effective for communication with said stationary condensate-transporting conduit means, said inlet opening means being juxtaposed to and open towards said cylindrical inner surface when said nozzle-like body means is operatively connected to said stationary condensate-transporting conduit means in order to achieve said communication with said outlet, said nozzle-like body means comprising a generally forwardly situated end surface and a rearwardly disposed end surface, said inlet opening means having a generally forwardly situated end portion and a rearwardly disposed end portion, said rearwardly disposed end portion being defined by a rearwardly situated end wall of said nozzle-like body means, said nozzle-like body means when operatively connected to said stationary condensate-transporting conduit means being so positioned as to have said forwardly and rearwardly disposed inlet opening end portions so arranged with respect to each other and said forwardly situated end surface and said rearwardly disposed end surface so arranged with respect to each other as to result in the rotating cylindrical inner surface first traversing said forwardly situated end surface and forwardly situated end portion and subsequently traverse said rearwardly situated end portion followed by traversing said rearwardly situated end wall and said rearwardly disposed end surface, and wherein said rearwardly situated end wall carries said rearwardly disposed end surface and comprises a generally inner surface means effective for scooping at least a portion of said condensate from said rotating cylindrical inner surface and directing such scooped condensate into said stationary condensate-transporting conduit means, wherein the inner width of said inlet opening means when measured parallel to said axis of rotation is as a maximum generally equal to the diameter of the flow passage defined by said condensate-transporting conduit means, wherein said forwardly situated inlet end portion extends as a recess-like opening through said forwardly situated end surface, said recess-like opening being so formed through said forwardly situated end surface as to result in those portions of said forwardly situated end surface which are located at opposite sides of said recess-like opening extending toward said cylindrical inner surface, and wherein the flow area of said recess-like opening is in the order of 0.1 to 0.2 of the cross-sectional flow area defined by said condensate-transporting conduit means.

2. An intake structure according to claim 1 wherein said rearwardly disposed end surface is formed as to be inclined with respect to the said cylindrical inner surface, and wherein the inclination of said rearwardly disposed end surface is in the order of 30°.

3. An intake structure according to claim 1 wherein said inlet opening means in width progressively narrows to a minimal width as said inlet opening means extends rearwardly from said forwardly situated end portion, and wherein said inlet opening means progressively widens to a width substantially equal to the cross-sectional size of the flow path defined by said condensate-transporting conduit means as said inlet opening means extends rearwardly from said minimal width.

4. An intake structure according to claim 1 wherein the cross-sectional flow area of said inlet opening means progressively decreases to a minimal cross-sectional flow area as said inlet opening means extends rearwardly from said forwardly situated end portion, and wherein the cross-sectional flow area of said inlet opening means progressively increases to be substantially equal to the cross-sectional flow area of said condensate-transporting conduit means as said inlet opening extends rearwardly from said minimal cross-sectional flow area.

5. An intake structure for receiving therein condensate from an inner chamber of a steam heated drying cylinder assembly which is rotatable about an axis of rotation, which has a generally cylindrical inner surface defining a portion of said inner chamber and against which said condensate forms, and which has a stationary condensate-transporting conduit means for delivering condensate to a receiving area externally of said drying cylinder assembly, said intake structure comprising nozzle-like body means, an inlet opening formed in said nozzle-like body means, an outlet formed in said nozzle-like body means and being effective for communication with said stationary condensate-transporting conduit means, said inlet opening being juxtaposed to and open towards said cylindrical inner surface when said nozzle-like body means is operatively connected to said stationary condensate-transporting conduit means in order to achieve said communication with said outlet, said inlet opening having a generally forwardly situated end and a rearwardly disposed end, said rearwardly disposed end being defined by a rearwardly situated end wall, said nozzle-like body means when operatively connected to said stationary condensate-transporting conduit means being so positioned as to have said forwardly and rearwardly disposed inlet opening ends so arranged with respect to each other as to result in the rotating cylindrical inner surface first traversing said forwardly situated end and subsequently traverse said rearwardly situated end followed by traversing said rearwardly situated end wall, and wherein said rearwardly situated end wall comprises a generally inner surface means effective for scooping at least a portion of said condensate from said rotating cylindrical inner surface and directing such scooped condensate into said stationary condensate-transporting conduit means, wherein the inner width of said inlet opening when measured parallel to said axis of rotation is generally equal to the diameter of the flow passage defined by said condensate-transporting conduit means, wherein said nozzle-like body means comprises a forwardly situated wall extending towards said cylindrical inner surface when said nozzle-like body means is operatively connected to said stationary condensate-transporting conduit means in order to achieve said communication with said outlet, wherein said forwardly situated inlet end continues as a recess through said forwardly situated wall, said recess being formed in that portion of said forwardly situated wall which is juxtaposed to said cylindrical inner surface.

6. An intake structure according to claim 5 wherein the flow area of said recess is in the order of 0.1 to 0.2 of the cross-sectional flow area defined by said condensate-transporting conduit means.

* * * * *